US006299472B1

(12) United States Patent
Beukes

(10) Patent No.: US 6,299,472 B1
(45) Date of Patent: Oct. 9, 2001

(54) CONNECTOR

(76) Inventor: Christo Andre Beukes, 332 Cork Ave., Ferndale, Randburg 2194 (ZA)

( * ) Notice: Subject to any disclaimer, the term of this patent is extended or adjusted under 35 U.S.C. 154(b) by 0 days.

(21) Appl. No.: 09/446,076

(22) PCT Filed: Jun. 25, 1998

(86) PCT No.: PCT/AU98/00488

§ 371 Date: Mar. 8, 2000

§ 102(e) Date: Mar. 8, 2000

(87) PCT Pub. No.: WO99/00873

PCT Pub. Date: Jan. 7, 1999

(30) Foreign Application Priority Data

Jun. 26, 1997 (ZA) ..... 97/5664

(51) Int. Cl.[7] ..... H01R 4/24
(52) U.S. Cl. ..... 439/403; 439/395; 439/402
(58) Field of Search ..... 439/403, 404, 439/456, 457, 459

(56) References Cited

U.S. PATENT DOCUMENTS

| | | | | |
|---|---|---|---|---|
| 4,461,528 | | 7/1984 | Durand | 339/98 |
| 5,009,612 | * | 4/1991 | Rishworth et al. | 439/403 |
| 5,759,065 | | 6/1998 | Hatagishi | 439/596 |
| 5,961,341 | | 10/1999 | Knowles | 439/405 |

FOREIGN PATENT DOCUMENTS

| | | |
|---|---|---|
| 43 06 868 C1 | 8/1994 | (DE) . |
| 4306868 | 8/1994 | (DE) . |
| 0 825 678 A2 | 2/1998 | (EP) . |
| 825678 | 2/1998 | (EP) . |
| 2 253 290 | 11/1973 | (FR) . |

OTHER PUBLICATIONS

Derwent Abstract Accession No. 97–151617/14, Class V04 JP 09–027356 A (Sumitomo Denso KK) Jan. 28, 1997.
Derwent Abstract Accession No. 97–151617/14, Class V04 JP 09–027356 A (Sumitomo Denso KK) Jan. 28, 1997.

* cited by examiner

*Primary Examiner*—Gary Paumen
*Assistant Examiner*—Alexander Gilman
(74) *Attorney, Agent, or Firm*—Pillsbury Winthrop LLP

(57) ABSTRACT

A connector which includes first and second components (12, 14) which are relatively movable to an intermediate position at which the components are engaged with each other in a first mode, and to an operative position at which the components are engaged with each other in a second mode, stop means (52) which, with the components in the first mode, prevents relative movement of the components to the operative position, and terminal means (104, 106) on the first component which is electrically connectable to an electrical conductor (132, 134) which extends from the first component, the electrical conductor then interacting with the stop means in such a way that the components are relatively movable from the intermediate position to the operative position.

13 Claims, 3 Drawing Sheets

CONNECTOR

BACKGROUND OF THE INVENTION

This invention relates to an electrical connector suitable for making electrical connections between at least two electrical conductors, which may extend transversely to each other.

A connector of the aforementioned type finds particular application in the making of electrical connections between trunk and branch lines. For example, in a detonating system, a main line, also known as a trunk line, consisting of a twisted pair of wires, is connected at spaced intervals to branch lines, each of which may comprise a pair of wires, leading to respective detonators.

The branch lines may be connected to the respective connectors under factory conditions to reduce on-site labour requirements The need then exists for a simple and reliable method of making connections h n the respective connectors and the trunk line. Preferably means should be provided for protecting the conductive parts of the connector against corrosion and, once electrical connections have been made to the connector, for rendering the connector splash- or waterproof.

The invention is described hereinafter with reference to a connector which is particularly suitable for use in a blasting system, e.g. for the mining or quarrying industry, but it is to be understood that the scope of the invention is not restricted to any specific application.

SUMMARY OF THE INVENTION

The invention provides a connector which includes first and second components which are relatively movable to an intermediate position at which the components are engaged with each other in a first mode, and to an operative position at which the components are engaged with each other in a second mode, stop means which, with the components in the first mode, prevents relative movement of the components to the operative position, and terminal means on the first component which is electrically connectable to an electrical conductor which extends from the first component, the electrical conductor then interacting with the stop means in such a way that the components are relatively movable from the intermediate position to the operative position.

As used herein the word "conductor" includes a single wire conductor or multi-wire conductors The terminal means may include a respective terminal for each wire of the conductor.

The terminal means preferably comprises insulation displacement terminals.

The terminal means may include at least a first terminal for connection to the aforementioned electrical conductor, also referred to as a trunk line, and at least a second terminal for connection to a second, or branch, conductor.

The branch conductor may be connected to the terminal means under factory conditions.

The stop means may take on any suitable form and, in one form of the invention, the stop means includes at least first and second members which are on the respective components and which are brought into abutting engagement with each other with the components in the first mode thereby preventing movement of the components to the operative position.

The first member may interact with the electrical conductor in such a way that the first member is deformed, or moved out of engagement with the second member, when the components are relatively moved towards the operative position One component may include a first formation, which may be in the form of a recess, which is adapted to receive a protective fluent material such as a grease or similar substance. The other component may include a second formation which is complementary to the first formation and which, when the components are moved to the operative position, bears against the protective material forcing the protective material into any void or open space between the first formation and the second formation.

The connector may include first catch means for retaining the components in the first mode and second catch means for retaining the components in the second mode. The first and second catch means may be releasable by deforming or bending at least part of at least one component.

According to a different aspect of the invention there is provided a connector which includes first and second components, insulation displacement terminals on the first component for effecting electrical connections between trunk and branch lines which extend from the component, and stop means on at least one of the components which, in the absence of at least the trunk line, prevents engagement of the first component with the second component and which, in the presence of at least the trunk line, interacts with the trunk line in such a way that the first component is engagable with the second component.

The connector may include catch mans for retaining the first component in engagement with the second component.

The connector may include additional catch means for retaining the first component at an intermediate position relatively to the second component. The aforementioned stop means may be operative with the components at the said intermediate position.

Preferably the terminals are arranged so that the trunk line and the branch line are substantially at right angles to one another.

BRIEF DESCRIPTION OF THE DRAWINGS

The invention is further described by way of example with reference to the accompanying drawings in which.

DESCRIPTION OF PREFERRED EMBODIMENT

Figure 1:
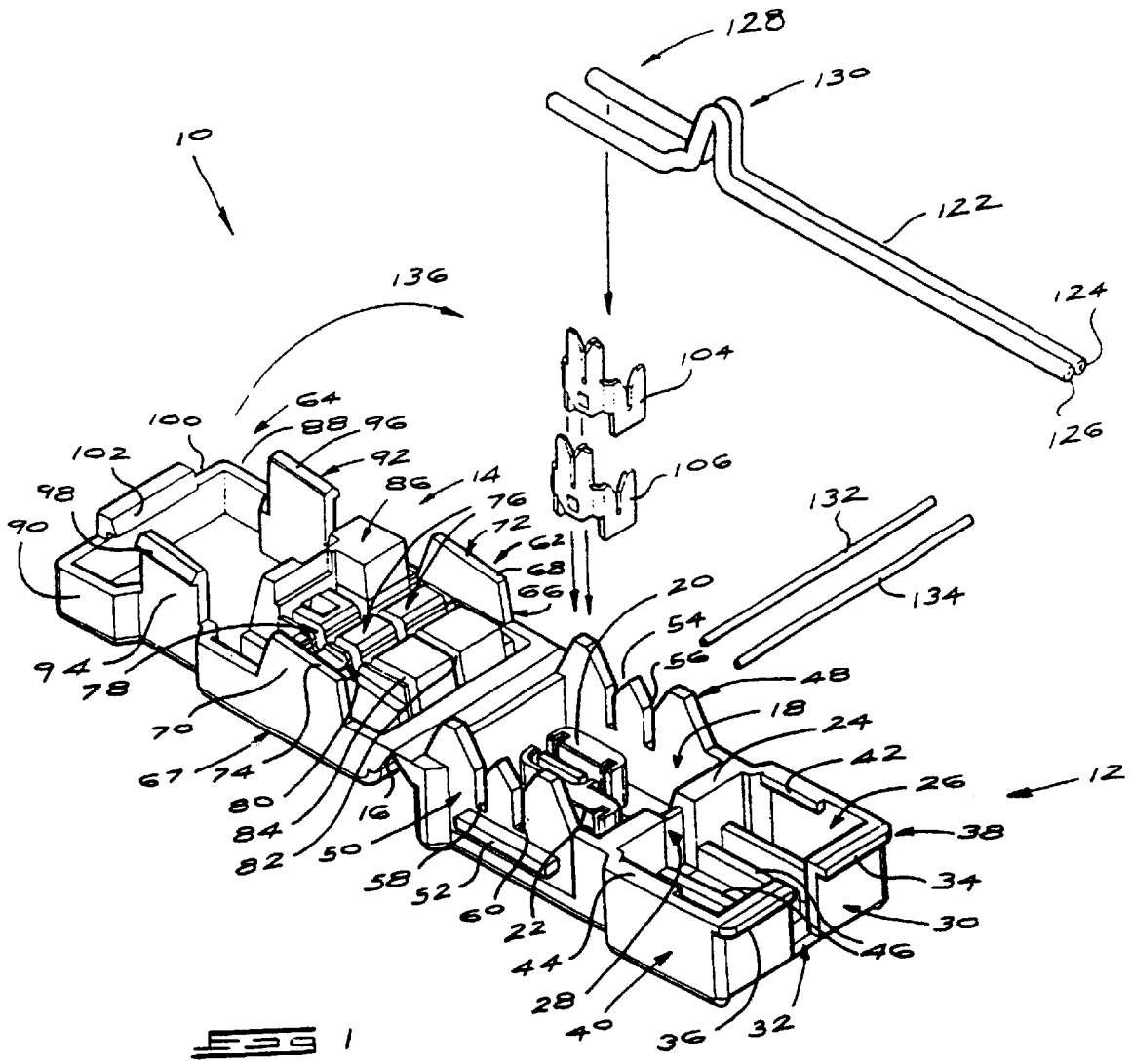
FIG. 1 is a perspective view of a connector according to the invention, with the connector in an open position and with certain parts in an exploded position.

FIG. 1 of the accompanying drawings illustrates a connector 10 according to one form of the invention which includes a first component 12, a second component 14, and a hinge 16 which interconnects the two components.

The components and the hinge are integrally moulded from a suitable plastics material and the hinge 16 is formed, in a manner known per se, from a bridging strip of the plastics material.

The first component 12 includes a recessed compartment 18 which houses two upstanding pedestals 20 and 22 respectively. An inner wall 24 which bounds one side of the compartment 18 also forms a boundary wall for a second recessed compartment 26. The wall 24 has a centrally positioned notch 28 on an upper end.

An end wall 30 of the component 12 forms a side wall of the second compartment 26 which opposes the wall 24. The end wall has a centrally positioned slot 32 and two outwardly extending catch formations 34 and 36 at what, in FIG. 1, is an upper edge of the wall. The catch formations 34 and 36 are on opposing sides of the slot 32.

Side walls 38 and 40 of the second compartment 26 have inwardly extending catch formations 42 and 44 at their upper edges. Two dividing walls, designated 46, extend inside the second compartment 26 from the wall 24 to the opposing end wall 30.

The component 18 has side walls 48 and 50 and each wall has an outwardly projecting ledge 52. Only one ledge is visible in FIG. 1. Each side wall has two spaced vertically extending slots 54 and 56, and 58 and 60, respectively. The slots 54 and 56 respectively oppose the slots 58 and 60.

The second component 14 is formed into two sections 62 and 64 respectively which are intended to mate with the compartments 18 and 26.

The section 62 has side walls 66 and 67 which have flaps 68 and 70 respectively which, in FIG. 1, are upstanding. The flaps have sloping upper edges 72 and 74 respectively.

The section 62, between the side walls 64 and 66, has upstanding formations 76.

Two grooves 78 and 80 extend transversely upper surfaces of the formations. Slots 82 and 84, which extend into the formations 76 deeper than the grooves 78 and 80, extend at right angles to the grooves, in the formations.

The sections 62 and 64 are separated by means of a wall 86.

The section 64 has side walls 88 and 90 respectively with upstanding portions 92 and 94 which are terminated, at their upper edges, by means of outwardly extending hook formations 96 and 98 respectively.

The section 64 has an end wall 100 with an inwardly facing hook formation 102 at an upper edged of the wall.

Figure 2:
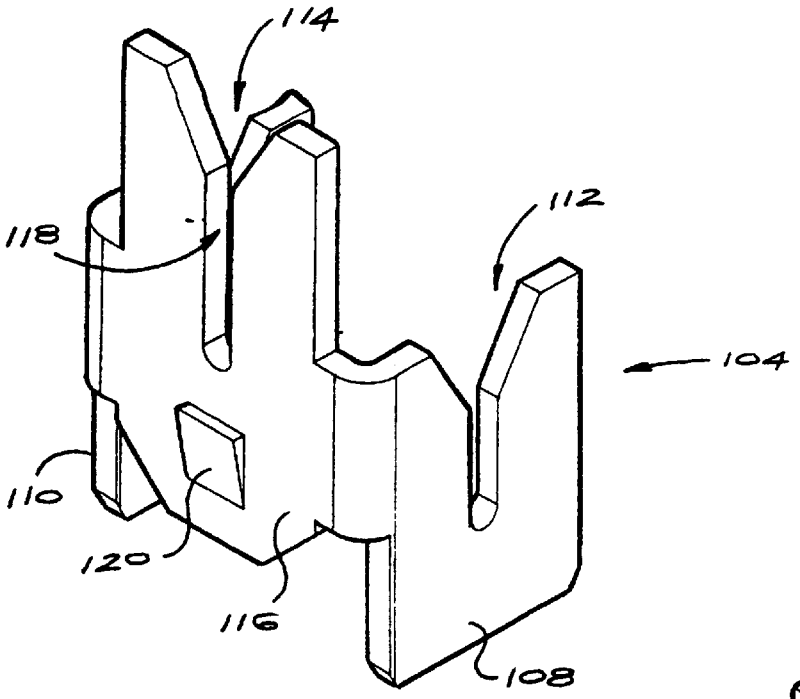
FIG. 2 is an enlarged perspective view of a terminal for use in the connector of FIG. 1.

FIG. 1 also illustrates two metallic conductive terminal posts 104 and 106 which have similar constructions and which are shown in enlarged detail in FIG. 2. Each terminal post is U-shaped in cross section and is formed with integral limbs 108 and 110 with V-shaped insulation displacement formations 112 and 114 respectively, and a base member 116 which, in FIG. 2, extends higher than the limbs, and which has a centrally positioned insulation displacement formation 118. An anchor formation 120 is positioned on a side of the base member.

The two terminal posts 104 and 106 are engagable in complementary recesses formed in the pedestals 20 and 22 in the compartment 18. The anchor formations 120 assist in locking the terminal posts frictionally in position, engaged with the pedestals.

As shown in FIG. 1 a branch line 122 which includes two side-by-side electrical wires 124 and 126 has one end 128 splayed so that the wires are slightly separated. Under factory conditions the end of the wire 124 is engaged with the registering formations 112 and 114 of the terminal post 104. The end of the wire 126 is similarly engaged with the corresponding formations on the terminal post 106. In a manner known per se the insulation on each wire is displaced and an electrical connection is made between the branch line and the terminal posts simply by inserting the wires into the respective formations.

The branch line is formed with a kink 130 which fits over the notch 28 in the wall 24. The side-by-side wires then lie between the dividing walls 46 and exit through the slot 32 in the end wall 30.

A blob of grease or any other suitable protective fluent material is placed in the compartment 18 over the terminal posts 104 and 106.

As previously stated the connector 10 is intended for use, in this example, in a blasting system At a blasting site the individual connectors are connected to detonators, not shown, and are also connected to a trunk line. The trunk line is used to control a blasting operation using technology which is known in the art.

FIG. 1 illustrates conductors 132 and 134 which extend transversely to the branch line 122. The conductors are normally provided as a loosely twisted pair of conductors. It is therefore possible to untwist the conductors slightly and position them side-by-side for engagement with the connector 10. The conductors are laid in the pairs of slots 54 and 58, and 56 and 60, respectively. Each conductor then lies in a respective formation 118 on the associated terminal post 104 and 106.

If the second component 14 is then hinged upwardly and over on to the first component 12, by movement in the direction of an arrow 136 shown in FIG. 1, the required movement is permitted and guided by the hinge 16. The formations 76 are brought into position above the pedestals 20 and 22 and the conductors 132 and 134 are hence forced into the shallow grooves 78 and 80.

The relatively deeper slots 82 and 84 receive the upstanding edges of the base members 116 of the terminal posts and urge the wires 132 and 134 deeper into the respective formations 118 thereby effecting electrical connections between the trunk line conductors and the branch line.

Figure 4:
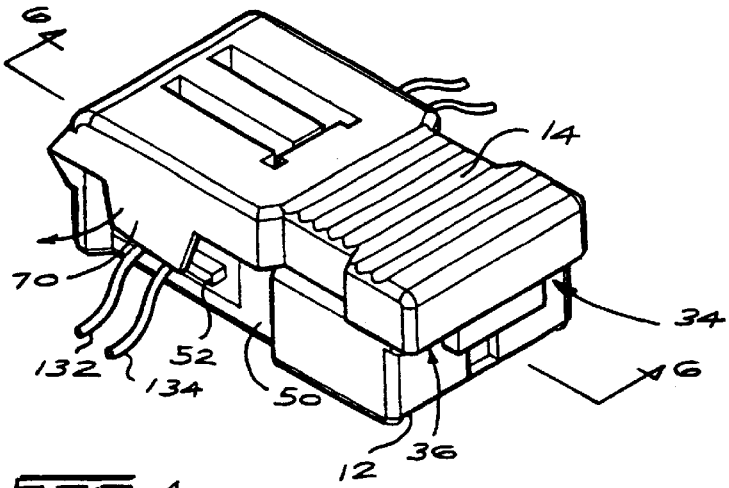
FIG. 4 shows the connector of FIG. 1 in an operative position.

When the component 14 is fully engaged with the component 12 the connector takes on the appearance shown in FIG. 4. The formations 76 mesh with the internal geometry of the compartment 18 and the grease or other protective fluent material is squeezed into all of the voids or open places in this compartment ensuring that all the electrical connections inside the connector are covered with the material. This provides a sound form of protection against the effects of water ingress and a substantial degree of splash- or waterproofing.

The hook formation 102 engages with the undersides of the catch formations 34 and 36 and the two components are thereby securely locked to one another.

As shown in FIG. 4 the conductors 132 and 134 lie over the two ledges 52 on the side walls 48 and 50. The flaps 68 and 70, being of a slightly resilient or flexible material, are bent outwardly, as shown in FIG. 4, and thus are deflected away from the upper surfaces of the ledges. The conductors 132 and 134, on each side of the connector, are therefore bent downwardly and positioned between opposing surfaces of the ledges and the two flaps.

Figure 3:
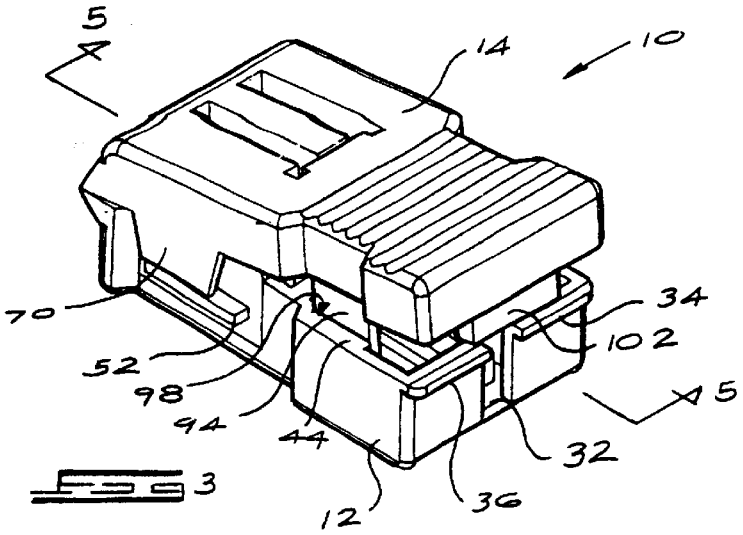
FIG. 3 is a view of the connector of FIG. 1 in an intermediate position.

FIG. 3 illustrates the connector 10 prior to the connector being coupled to the trunk line conductors 132 and 134. In FIG. 3 the branch line 122 has been omitted but it is to be understood that the branch line extends from the slot 32.

The side flaps 68 and 70 rest on the corresponding ledges 52. The hook formations 96 and 98 on the side portions 92 and 94 of the section 64 are engaged with the corresponding catch formations 42 and 44 on the side walls of the second compartment 26. Thus the connector is kept in an intermediate position by the abutment of the flaps with the ledges on the one hand and by the locking interaction of the aforementioned hook and catch formations.

When the connector is to be used the portions 92 and 94 are depressed slightly inwardly, towards each other, to release the hooks from the corresponding catch formations. The two components 12 and 14 can then be hinged outwardly to expose the inner construction of the connector, as indicated in FIG. 1. The trunk line can then be engaged with the terminal posts in the manner described. Thereafter, as has already been described, the two components are hinged into engagement with one another to the operative position shown in FIG. 4. In this case, due to the trunk conductors 132 and 134 which overlie the ledges 58 and which are normally bent slightly downwardly, the flaps 68 and 70 are deflected outwardly and are moved away from the ledges. There is no significant impediment therefore to the two components engaging fully with each other, as shown in FIG. 4, and when the FIG. 4 mode is reached the components are held to one another by means of the hook 102 engaging with the catch formations 34 and 36.

It should be borne in mind that in the operative position of the connector the fluent protective material in the compartment 18 is filly dispersed throughout the compartment and effectively seals the compartment against the ingress of moisture.

The trunk line wires 132 and 134 are also held frictionally in position, at least to a limited extent, by means of their engagement with the respective slots 54 and 58, and 56 and 60. The branch line 122 is also held physically in position by means of the kink 130 engaging with the notched wall 24. Thus, apart from effecting an electrical connection between the conductors, a fairly significant mechanical bond is established between the conductors at the same time.

Figure 5:
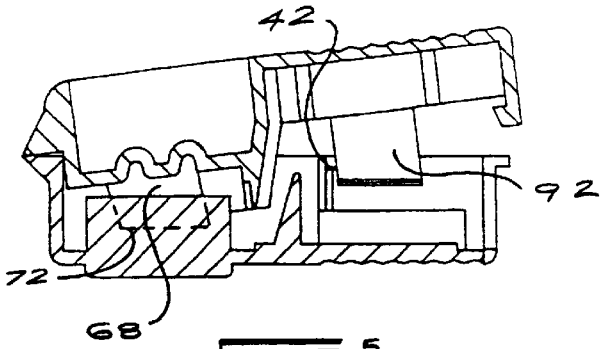
FIG. 5 is a cross-sectional side view of the connector shown in FIG. 3 taken on the line 5—5.
Figure 6:
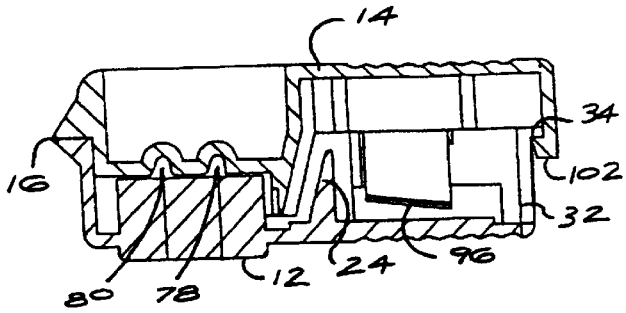
FIG. 6 is a cross-sectional side view of the connector of FIG. 4 taken on the line 6—6.

FIGS. 5 and 6 respectively are cross-sectional views of the connector in the FIG. 3 and FIG. 4 mode. From FIG. 5 it is apparent that the angled edges 72 and 74 of the flaps 68 and 70 are aligned with the upper surfaces of the respective ledges and, similarly, the angled hook formations 96 and 98 of the side portions 92 and 94 are aligned with the upper surfaces of the catch formations 42 and 44. On the other hand, as shown in FIG. 6, the alignment is not necessary when the connector is in the operative position for, at this stage, the hook 102 is brought into engagement with the catches 34 and 36.

Figure 7:
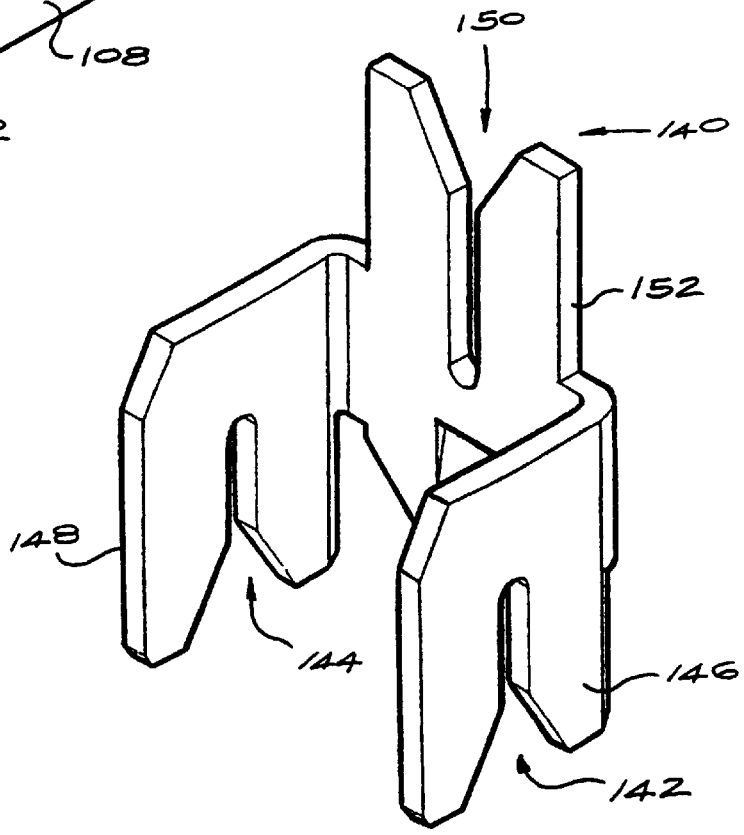
FIG. 7 illustrates a terminal which can be used as an alternative to the terminal shown in FIG. 2 with the connector of the invention.

The terminals 104 and 106 face upwardly and receive the respective wires which are urged downwardly into the insulation displacement formations. FIG. 7 shows a terminal post 140 according to a different arrangement which has downwardly facing insulation displacement formations 142 and 144 in limbs 146 and 148, and an upwardly facing insulation displacement formation 150 in a base member 152. When posts of the type 140 are used in place of the posts 104 and 106 the branch lines are connected to the posts effectively by stapling the posts in position with the branch lines sandwiched between opposing surfaces of the component 12 and the terminal post. The trunk line is connected to the upwardly facing insulation displacement formations 150 in a manner analogous to what has been described hereinbefore.

The intermediate closure position for the connector, shown in FIGS. 3 and 5, means that when the connections are made to the conductors 132 and 134 the free volume available in the combined compartments 18 and 62, which are grease filled in the factory, is reduced as the connector is closed to the final position shown in FIGS. 4 and 6. As a result, the grease is displace throughout the compartment and covers the connectors and terminals rendering the connections between the branch and trunk lines waterproof.

Another development is to fabricate the connector components from a translucent material, or with a window, and to include a light emitting device e.g. an LED, inside the components connected to the branch fines 122. If the trunk line is powered, and the connections between the trunk and branch lines are sound, then the device will glow and this will be externally and immediately visible.

Throughout this section and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

What is claimed is:

1. A connector which includes first and second components which are relatively movable to an intermediate position at which the components are engaged with each other in a first mode, and to an operative position at which the components are engaged with each other in a second mode, stop means which, with the components in the first mode, prevents relative movement of the components to the operative position, and terminal means on the first component which is electrically connectable to an electrical conductor which extends from the first component, the electrical conductor then interacting with the stop means in such a way that the components are relatively movable from the intermediate position to the operative position.

2. A connector according to claim 1 wherein one component includes a first formation, which may be in the form of a recess, which is adapted to receive a protective fluent material and the other component includes a second formation which is complementary to the first formation and which, when the components are moved to the operative position, bears against the protective material forcing the protective material into any void or open space between the first formation and the second formation.

3. A connector according to claim 1 which includes first catch means for retaining the components in the first mode and second catch means for retaining the components in the second mode.

4. A connector according to claim 1 wherein the stop means includes at least first and second members which are on the reeve components and which are brought into abutting engagement with each other with the components in the first mode thereby preventing movement of the components to the operative position.

5. A connector according to claim 4 wherein the first member interacts with the electrical conductor in such a way that the first member is deformed, or moved out of engagement with the second member, when the components are relatively moved towards the operative position.

6. A connector according to claim 1 wherein the terminal means includes at least a first terminal for connection to the said electrical conductor, and at least a second terminal for connection to a second electrical conductor.

7. A connector according to claim 6 wherein the first and second terminals are positioned so that the said electrical conductor and the second electrical conductor, when respectively connected to the terminals, are substantively at right angles to each other.

8. A terminal post for use with a connector according to claim 1 which includes at least first and second conductive limbs which are at right angles to each other, and wherein each limb has a respective insulation displacement formation.

9. A connector which includes first and second components, insulation displacement terminals on the first component for effecting electrical connections between trunk and branch lines which extend from the component, and stop means on at least one of the components which, in the absence of at least the tun line, prevents engagement of the first component with the second component and which, in the presence of at least the trunk line, interacts with the trunk line in such a way that the first component is engagable with the second component.

10. A connector according to claim 9, wherein the terminals are arranged so that the trunk line and the branch line are substantially at right angles to one another.

11. A terminal post for use with a connector according to claim 9 which includes at least first and second conductive limbs which are at right angles to each other, and wherein each limb has a respective insulation displacement formation.

12. A connector according to claim 9 which includes catch means for retaining the first component in engagement with the second component.

13. A connector according to claim 12 which includes additional catch means for retaining the first component at an intermediate position relatively to the second component, and the stop means is operative, to prevent the said engagement of the first component with the second component, when the components are at the said intermediate position.

* * * * *

UNITED STATES PATENT AND TRADEMARK OFFICE

CERTIFICATE OF CORRECTION

PATENT NO. : 6,299,472 B1
DATED : October 9, 2001
INVENTOR(S) : Christo A. Beukes It is certified that error appears in the above-identified patent and that said Letters Patent is hereby corrected as shown below:

Title page,
Insert Item:
-- [73] Assignee: Expert Explosives (Pty.) Ltd., Modderfontein (ZA) --

Signed and Sealed this

Twentieth Day of January, 2004

JON W. DUDAS
*Acting Director of the United States Patent and Trademark Office*